US010500432B2

(12) United States Patent
Bentley

(10) Patent No.: US 10,500,432 B2
(45) Date of Patent: Dec. 10, 2019

(54) TRAINING DEVICE

(71) Applicant: LeCharles Bentley, Gilbert, AZ (US)

(72) Inventor: LeCharles Bentley, Gilbert, AZ (US)

( * ) Notice: Subject to any disclaimer, the term of this patent is extended or adjusted under 35 U.S.C. 154(b) by 0 days.

(21) Appl. No.: 15/396,656

(22) Filed: Dec. 31, 2016

(65) Prior Publication Data

US 2017/0189733 A1 Jul. 6, 2017

Related U.S. Application Data

(60) Provisional application No. 62/273,905, filed on Dec. 31, 2015.

(51) Int. Cl.

| | |
|---|---|
| ***A63B 21/06*** | (2006.01) |
| ***A63B 21/00*** | (2006.01) |
| ***A63B 69/00*** | (2006.01) |
| ***A63B 23/04*** | (2006.01) |

(52) U.S. Cl.

CPC ..... *A63B 21/06* (2013.01); *A63B 21/0004* (2013.01); *A63B 21/4035* (2015.10); *A63B 23/047* (2013.01); *A63B 69/002* (2013.01); *A63B 2243/007* (2013.01)

(58) Field of Classification Search

CPC ..... A63B 21/0004; A63B 21/06–08; A63B 21/062–0632; A63B 21/4035; A63B 23/047; A63B 69/002; A63B 69/345; A63B 2243/007; A63B 22/20–203

See application file for complete search history.

(56) References Cited

U.S. PATENT DOCUMENTS

| | | | | |
|---|---|---|---|---|
| 9,643,040 | B1 * | 5/2017 | Guerrero Diaz | A63B 21/0004 |
| 2011/0124474 | A1 * | 5/2011 | Gilman | A63B 21/0615 482/93 |
| 2011/0224051 | A1 * | 9/2011 | Larish | A63B 21/012 482/93 |
| 2011/0287907 | A1 * | 11/2011 | Morris | A63B 21/00069 482/117 |
| 2012/0172155 | A1 * | 7/2012 | Gilman | A63B 69/00 473/447 |
| 2013/0172160 | A1 * | 7/2013 | Poole | A63B 21/0552 482/129 |
| 2013/0324371 | A1 * | 12/2013 | Cayo | A63B 21/0618 482/87 |
| 2014/0073491 | A1 * | 3/2014 | Gilson | A63B 21/06 482/93 |
| 2016/0199688 | A1 * | 7/2016 | Briley | A63B 21/0615 482/97 |
| 2016/0361584 | A1 * | 12/2016 | Towley | A63B 21/06 |
| 2017/0326402 | A1 * | 11/2017 | Sorin | A63B 21/0442 |

* cited by examiner

*Primary Examiner* — Nyca T Nguyen

(74) *Attorney, Agent, or Firm* — Cooper Legal Group, LLC

(57) ABSTRACT

An exercise training device includes a sled portion extending along a first plane that is substantially parallel to a surface upon which the exercise training device is supported. The sled portion includes a first side that is in contact with the surface. A support structure, attached to the sled portion, includes a support surface that extends along a second plane that is substantially parallel to the first plane. The support surface supports an exercise weight. A handle portion is attached to one of the sled portion or the support structure, the handle portion allows a user to grip the exercise training device and move the exercise training device along the surface.

14 Claims, 16 Drawing Sheets

TRAINING DEVICE

CROSS-REFERENCE TO RELATED APPLICATIONS

This application claims priority to U.S. Provisional Patent Application No. 62/273,905, filed on Dec. 31, 2015, the entire disclosure of which is hereby incorporated by reference.

TECHNICAL FIELD

The instant application is generally directed towards an exercise training device. For example, the instant application is directed towards an exercise training device for improving the strength of an athlete.

BACKGROUND

Exercise training devices may be used to help athletes. Such devices may be used, for example, to help athletes train in a variety of different sports.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

In an example, an exercise training device comprises a sled portion extending along a first plane that is substantially parallel to a surface upon which the exercise training device is supported. The sled portion comprises a first side that is in contact with the surface. A support structure, attached to the sled portion, comprises a support surface that extends along a second plane that is substantially parallel to the first plane. The support surface is configured to support an exercise weight. A handle portion is configured to be attached to one of the sled portion or the support structure. The handle portion is configured to allow a user to grip the exercise training device and move the exercise training device along the surface.

In an example, an exercise training device comprises a sled portion extending along a first plane that is substantially parallel to a surface upon which the exercise training device is supported. The sled portion comprises a first side that is in contact with the surface. A support structure, attached to the sled portion, comprises a support surface that extends along a second plane that is substantially parallel to the first plane. The support surface is configured to support an exercise weight. A handle support structure is attached to one of the sled portion or the support structure. A handle portion is configured to be removably attached to the handle support structure. The handle portion is configured to allow a user to grip the exercise training device and move the exercise training device along the surface.

In an example, an exercise training device comprises a sled portion extending along a first plane that is substantially parallel to a surface upon which the exercise training device is supported. The sled portion comprises a first side that is in contact with the surface. A handle support structure is attached to the sled portion. A handle portion is configured to be removably attached to the handle support structure. The handle portion is configured to allow a user to grip the exercise training device and move the exercise training device along the surface. The handle portion is angled relative to the sled portion such that the handle portion is at other than a 90 degree angle relative to the first plane.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
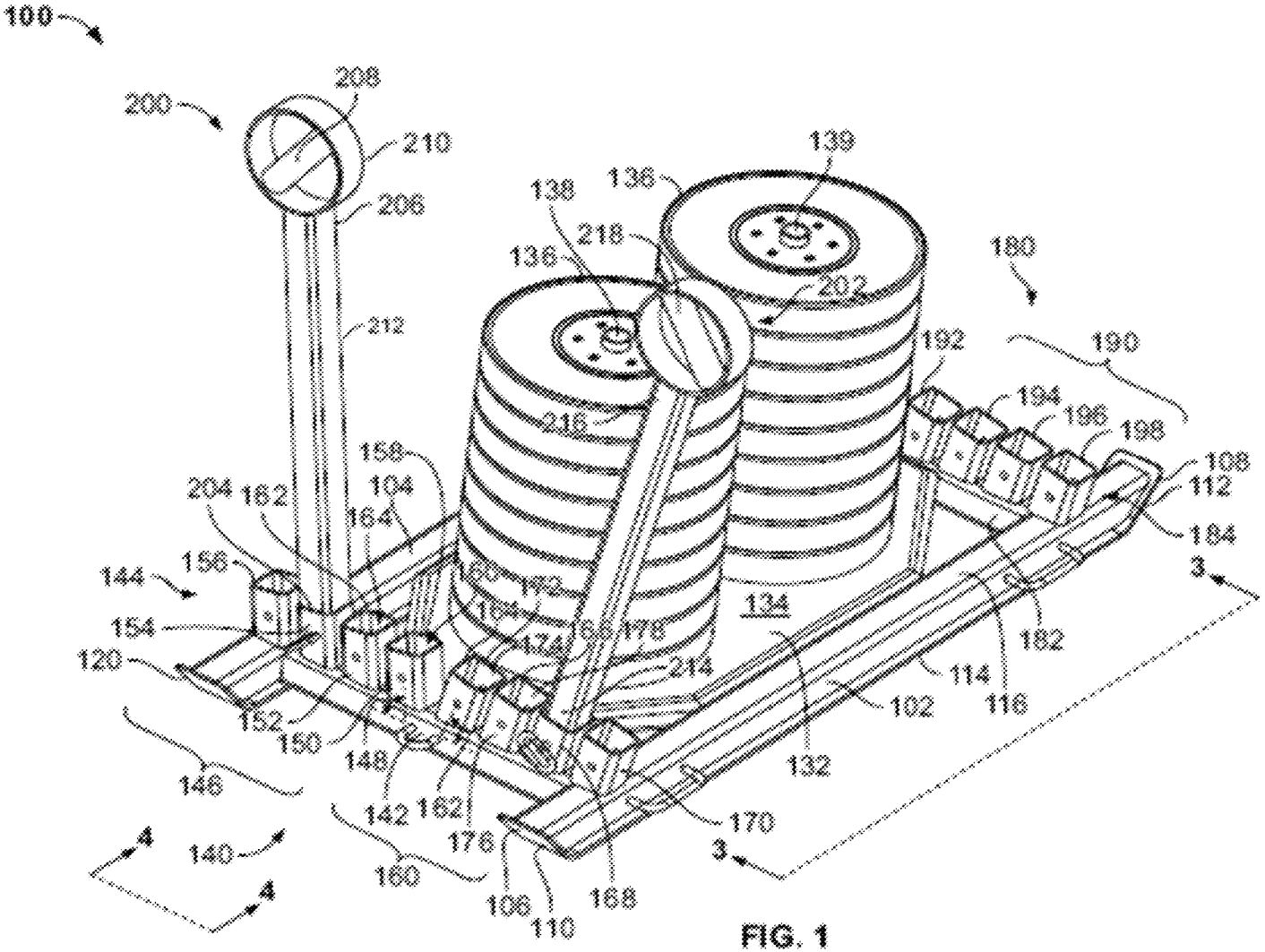
FIG. 1 is an illustration of an example training device.

The following disclosure provides many different embodiments, or examples, for implementing different features of the provided subject matter. Specific examples of components and arrangements are described below to simplify the present disclosure. These are, of course, merely examples and are not intended to be limiting. For example, the attachment of a first feature and a second feature in the description that follows may include embodiments in which the first feature and the second feature are attached in direct contact, and may also include embodiments in which additional features may be positioned between the first feature and the second feature, such that the first feature and the second feature may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 2:
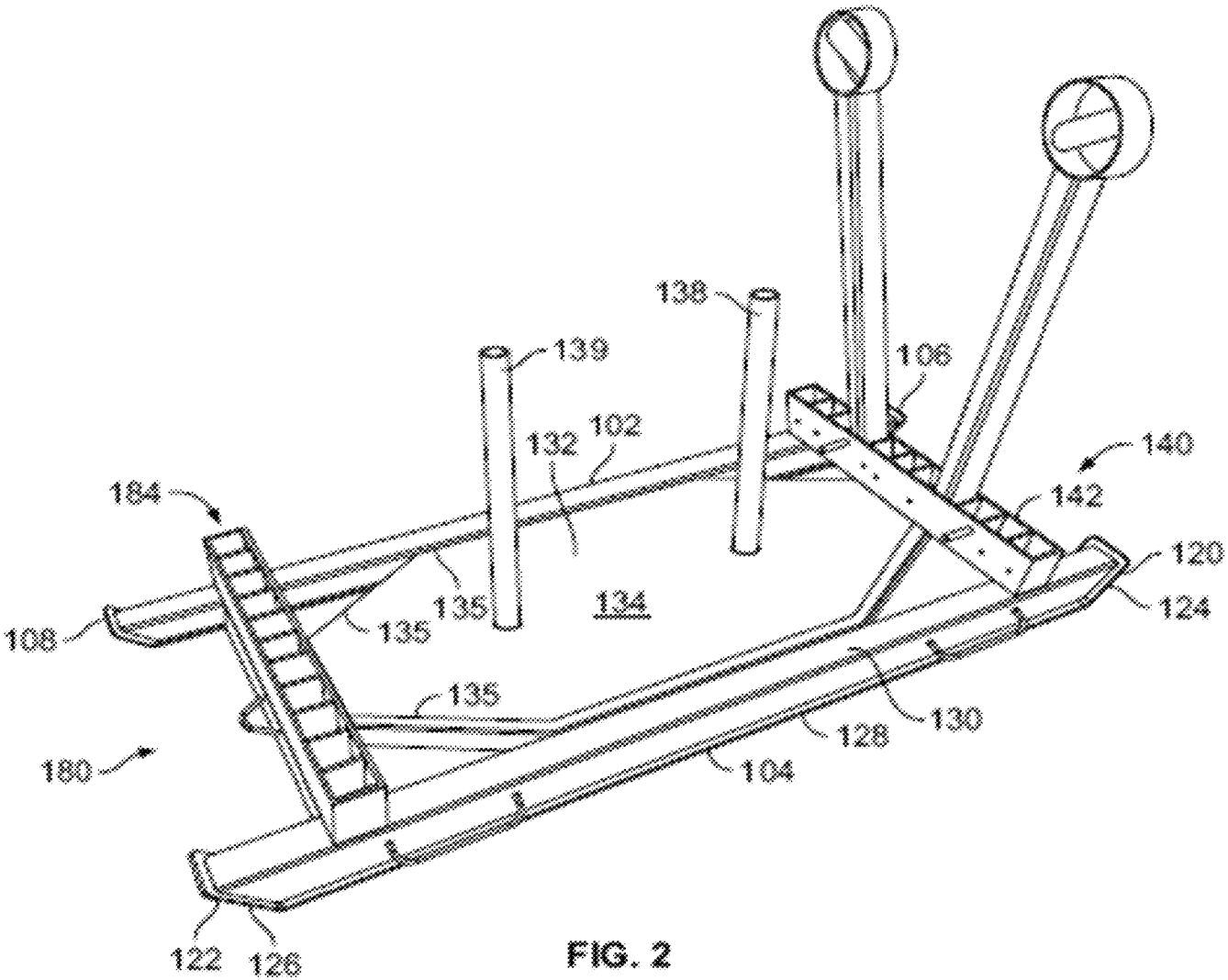
FIG. 2 is an illustration of an example training device.

Referring to FIGS. 1 and 2, an exercise training device 100 is provided for athletic training in a variety of sports. In an example, the exercise training device 100 could be used for football training, such as assisting offensive linemen with footwork and maintaining balance while increasing strength and keeping a relatively low center of gravity. In an example training technique, exercise weights can be added to the exercise training device 100. An athlete can grip or hold a handle portion of the exercise training device 100, while applying a pushing force to the exercise training device 100. In this way, the force applied by the athlete can cause the exercise training device 100 to slide along a surface (e.g., the ground), while increasing the strength, balance, footwork, hand placement, etc. of the athlete.

The exercise training device 100 comprises one or more sled portions, such as a sled portion 102 and a second sled portion 104. The sled portion 102 and the second sled portion 104 can be supported on a surface, such as the ground, a playing surface (e.g., a turf field, a grass field, etc.), etc. An athlete may apply a force to the exercise training device 100 in a direction that is substantially parallel to the surface. In response to a force applied by the athlete, the exercise training device 100 may move with respect to the surface.

The sled portion 102 can extend between a first end 106 and a second end 108. In an example, the sled portion 102 comprises a first ramp portion 110 disposed at the first end 106 and a second ramp portion 112 disposed at the second end 108. The first ramp portion 110 and the second ramp portion 112 define angled surfaces that may be non-parallel and non-perpendicular with respect to the surface along which the exercise training device 100 is moved. In an example, the first ramp portion 110 and the second ramp portion 112 can define an angle that is between about 30 degrees to about 60 degrees with respect to the surface. In this way, the first ramp portion 110 and the second ramp portion 112 can facilitate movement of the sled portion 102 along the surface while limiting the sled portion 102 from inadvertently becoming caught or fixed with respect to the surface.

The sled portion 102 comprises a first side 114 and a second side 116. The first side 114 may be in contact with the surface, such that the first side 114 may be downwardly facing. The second side 116 can face in a direction away from the first side 114, such that the second side 116 may be upwardly facing. In an example, the sled portion 102 defines a side of the exercise training device 100, and may comprise handles 118 or the like to facilitate ease of carrying of the exercise training device 100. The first side 114 may be substantially flat or planar to allow for ease of movement relative to the surface.

The second sled portion 104 of the exercise training device 100 can extend substantially parallel to the sled portion 102 and between a third end 120 and a fourth end 122. In an example, the second sled portion 104 comprises a third ramp portion 124 disposed at the third end 120 and a fourth ramp portion 126 disposed at the fourth end 122. The third ramp portion 124 and the fourth ramp portion 126 define angled surfaces that may be non-parallel and non-perpendicular with respect to the surface along which the exercise training device 100 is moved. In an example, the third ramp portion 124 and the fourth ramp portion 126 can define an angle that is between about 30 degrees to about 60 degrees with respect to the surface. In this way, the third ramp portion 124 and the fourth ramp portion 126 can facilitate movement of the second sled portion 104 along the surface while limiting the second sled portion 104 from inadvertently becoming caught or fixed with respect to the surface.

The second sled portion 104 comprises a third side 128 and a fourth side 130. The third side 128 may be in contact with the surface, such that the third side 128 may be downwardly facing. The fourth side 130 can face in a direction away from the third side 128, such that the fourth side 130 may be upwardly facing. In an example, the second sled portion 104 defines a side of the exercise training device 100, and may comprise handles (e.g., similar to the handles 118 of the sled portion 102) or the like to facilitate ease of carrying of the exercise training device 100. The third side 128 may be substantially flat or planar to allow for ease of movement relative to the surface.

In an example, the first end 106 of the sled portion 102 and the third end 120 of the second sled portion 104 can be located along the same side of the exercise training device 100. Likewise, in an example, the second end 108 of the sled portion 102 and the fourth end 122 of the second sled portion 104 can be located along the same side (e.g., opposite the first end 106 and the third end 120) of the exercise training device 100. In an example, the first side 114 and the third side 128 can face in the same direction (e.g., in contact with the surface) while the second side 116 and the fourth side 130 can face in the same direction (e.g., facing away from the surface).

The sled portion 102 and the second sled portion 104 can be spaced apart to define an opening, a gap, a space, or the like therebetween. In an example, the exercise training device 100 comprises a support structure 132 disposed between the sled portion 102 and the second sled portion 104. The support structure 132 can be attached to the sled portion 102 and/or the second sled portion 104, such as by welding, mechanical fasteners, adhesives, etc. In an example, the support structure 132 comprises a plurality of sides 135 (e.g., eight sides in the illustrated example), with one side bordering and/or attached to the sled portion 102 and an opposing second side bordering and/or attached to the second sled portion 104. However, in other examples, the support structure 132 may comprise any number of sides.

The support structure 132 comprises a support surface 134 that is configured to support an exercise weight 136. The support surface 134 may be substantially flat/planar and can extend substantially parallel to the surface upon which the exercise training device 100 rests. The support surface 134 can face away from the surface, such that the exercise weights 136 can rest upon the support surface 134. In this way, the exercise weights 136 can increase the weight of the exercise training device 100, thus increasing the resistance that an athlete must overcome when pushing the exercise training device 100.

Figure 3:
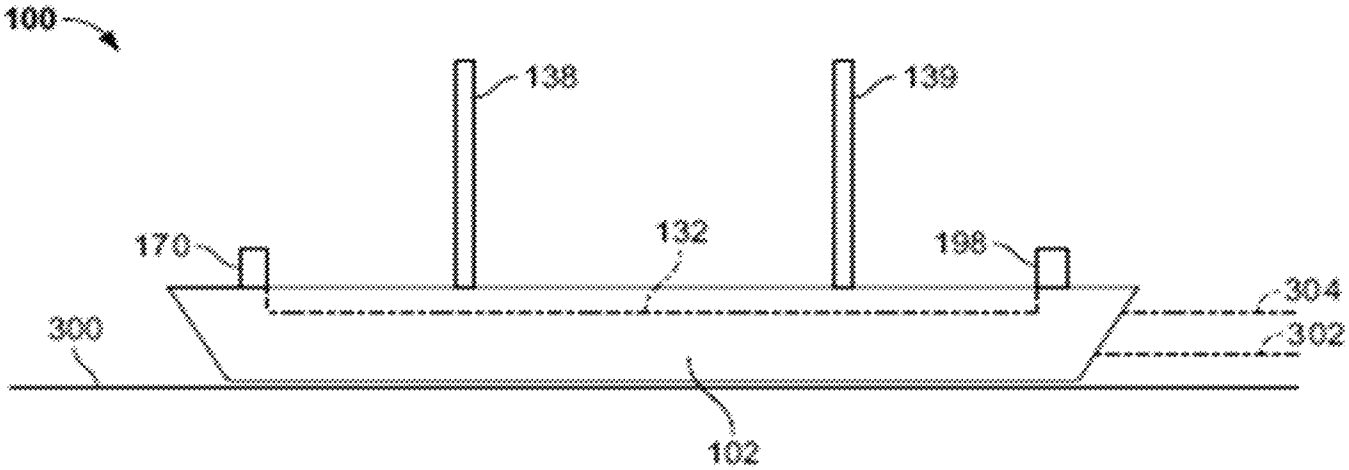
FIG. 3 is an illustration of a side of an example training device.

The support structure 132 comprises an engagement member 138 and a second engagement member 139 (e.g., also illustrated in FIGS. 2 and 3). The engagement member 138 and the second engagement member 139 can be attached to the support surface 134 and may extend linearly opposite the surface upon which the exercise training device 100 rests. In an example, the engagement member 138 and the second engagement member 139 can comprise a rod, a bar, a pole, a shaft, or other similar structure that may be rigidly and/or fixedly attached to the support surface 134. One or both of the engagement member 138 and the second engagement member 139 can receive the exercise weights 136 so as to maintain the exercise weights 136 with respect to the support surface 134 and limit the exercise weights 136 from being inadvertently removed or separated from the support surface 134. The engagement member 138 and the second engagement member 139 can be spaced a distance apart from one another to define a gap, a space, an opening, or the like, within which portions of the exercise weights 136 can be received.

The exercise training device 100 comprises a handle support structure 140 attached to one or more of the sled portion 102 the second sled portion 104, or the support structure 132. In an example, the handle support structure 140 comprises a support bar 142 that may be attached to the first end 106 of the sled portion 102 and the third end 120 of the second sled portion 104. The support bar 142 may define a side of the exercise training device 100, and can function to maintain relative positions of the sled portion 102 with respect to the second sled portion 104 (e.g., distance between the sled portion 102 and the second sled portion 104, parallel orientation of the sled portion 102 and the second sled portion 104, etc.).

The handle support structure 140 comprises one or more support portions 144. In an example, the support portions 144 may be attached to the support bar 142, the sled portion 102, and/or the second sled portion 104. The support portions 144 can be position on a side of the support bar 142, the sled portion 102, and/or the second sled portion 104 that faces away from the surface. In an example, the support portions 144 may be defined by two continuous walls that extend between opposing sides of the exercise training device 100, such as in the example illustrated in FIG. 2. In an example, the support portions 144 may be defined by wall that are spaced apart and separated from adjacent walls that define an adjacent support portion 144.

In an example, the handle support structure 140 comprises a first set 146 of the support portions 144 that define a first angle 148 with respect to the support bar 142. The first set 146 can comprise one or more of the support portions 144, such as a first support portion 150, a second support portion 152, a third support portion 154, and a fourth support portion 156. In an example, the first support portion 150, the second support portion 152, and the third support portion 154 can be attached to the support bar 142, while the fourth support portion 156 can be attached to the second sled portion 104. In an example, the first support portion 150, the second support portion 152, the third support portion 154, and the fourth support portion 156 can extend substantially parallel to each other.

The first support portion 150 comprises a first wall 158 that defines a first opening 160. In an example, the first wall 158 defines a substantially quadrilateral shape (e.g., square), such that the first opening 160 has a square shape. In other examples, the first wall 158 can define other shapes, such as rectangular, oval, circular, etc. The second support portion 152 is similar to the first support portion 150, and comprises a second wall 162 that defines a second opening 164. In an example, the second wall 162 defines a substantially quadrilateral shape (e.g., square), such that the second opening 164 has a square shape. The third support portion 154 and the fourth support portion 156 can be substantially similar to the first support portion 150 and the second support portion 152, such as by having a third wall and a fourth wall that define a third opening and a fourth opening that are substantially similar to the first opening 160 and the second opening 162.

It will be appreciated that the support portions 144 and handle portions (e.g., 200, 202) illustrated herein are not limited to the quadrilateral (e.g., square) cross-sectional shapes of FIGS. 1 and 2. Rather, some or all of the support portions 144 and/or handle portions can have differing sizes and shapes. For example, one or more of the support portions 144 and/or handle portions can have other quadrilateral shapes (e.g., rectangular, etc.) or non-quadrilateral shapes (e.g., circular, oval, etc.). In an example, one or more of the support portions 144 may have a cross-sectional shape that is non-symmetrical (e.g., trapezoidal, etc.). In an example, one or more of the support portions 144 can have a first shape, while other support portions 144 can have a second shape that differs from the first shape, while other support portions 144 can have a third shape that differs from the first shape and the second shape, etc. In an example, one or more of the support portions 144 can have differing cross-sectional sizes and/or shapes. Likewise, in an example, one or more of the handle portions (e.g., 200, 202) can have different sizes and/or shapes (e.g., that match one or more cross-sectional sizes and/or shapes of the support portions 144, such that the handle portions can be received within the support portions 144). Different handle portions can be longer, taller, wider, stronger, thicker, etc. have different shapes, angles, etc. grips (e.g., first angle for left hand and second angle for right hand, etc.) relative to one another. One or more handle portions may have a vertical adjustment (e.g., telescoping feature, etc.) (e.g., so as to accommodate users of different heights, arm lengths, etc.). Different support portions 144 can be angled, oriented, etc. differently relative to one another (e.g., so that first handle portion supported by first support portion is at a different angle, orientation, etc. relative to second handle portion supported by second support portion (e.g., so that left arm/hand is trained differently than right arm/hand). One or more support portions can be received in one or more handle portions, rather than handle portions being received in support portions as illustrated (e.g., inner cross-sectional dimension of a handle portion may be larger than outer cross-sectional dimension of a support portion. One or more support portions can be substantially longer than one or more handle portions (e.g., contrary to the illustrated examples where handle portions are longer than support portions).

In an example, the handle support structure 140 comprises a second set 160 of the support portions 144 that define a second angle 162 with respect to the support bar 142. The second set 160 can comprise one or more of the support portions 144, such as a fifth support portion 164, a sixth support portion 166, a seventh support portion 168, and an eighth support portion 170. In an example, the fifth support portion 164, the sixth support portion 166, and the seventh support portion 168 can be attached to the support bar 142, while the eighth support portion 170 can be attached to the sled portion 102. In an example, the fifth support portion 164, the sixth support portion 166, the seventh support portion 168, and the eighth support portion 170 can extend substantially parallel to each other.

The fifth support portion 164 comprises a fifth wall 172 that defines a fifth opening 174. In an example, the fifth wall 172 defines a substantially quadrilateral shape (e.g., square), such that the fifth opening 174 has a square shape. In other examples, the fifth wall 172 can define other shapes, such as rectangular, oval, circular, etc. The sixth support portion 166 is similar to the fifth support portion 164, and comprises a sixth wall 176 that defines a sixth opening 178. In an example, the sixth wall 176 defines a substantially quadrilateral shape (e.g., square), such that the sixth opening 178 has a square shape. The seventh support portion 168 and the eighth support portion 170 can be substantially similar to the fifth support portion 164 and the sixth support portion 166, such as by having a seventh wall and an eighth wall that define a seventh opening and an eighth opening that are substantially similar to the fifth opening 174 and the sixth opening 178.

The exercise training device 100 comprises a second handle support structure 180 attached to one or more of the sled portion 102 the second sled portion 104, or the support structure 132. In an example, the second handle support structure 180 comprises a second support bar 182 that may be attached to the second end 108 of the sled portion 102 and the fourth end 122 of the second sled portion 104. The second support bar 182 may define a side of the exercise training device 100, and can function to maintain relative positions of the sled portion 102 with respect to the second sled portion 104 (e.g., distance between the sled portion 102 and the second sled portion 104, parallel orientation of the sled portion 102 and the second sled portion 104, etc.).

In an example, the second handle support structure 180 is located opposite the handle support structure 140. In this way, the second handle support structure 180 and the handle support structure 140 define opposing sides of the exercise training device 100. In an example, the support bar 142 of the handle support structure 140 extends substantially parallel to the second support bar 182 of the second handle support structure 180. In an example, the support bar 142 and/or the second support bar 182 extend substantially perpendicular to the sled portion 102 and/or the second sled portion 104.

The second handle support structure 180 comprises one or more support portions 184. In an example, the support portions 184 may be attached to the second support bar 182, the sled portion 102, and/or the second sled portion 104. The support portions 184 can be position on a side of the support bar 142, the sled portion 102, and/or the second sled portion 104 that faces away from the surface.

In an example, the second handle support structure 180 comprises a first set of support portions 184 (e.g., obstructed from view in FIG. 1) that are substantially similar and/or identical to the first set 146 of the support portions 144 of the handle support structure 140. For example, the first set of support portions 184 may comprise a first support portion (e.g., first support portion 150), a second support portion (e.g., second support portion 152), a third support portion (e.g., third support portion 154), and a fourth support portion (e.g., fourth support portion 156).

The second handle support structure 180 comprises a second set 190 of the support portions 184 that are substantially similar and/or identical to the second set 160 of the support portions 144 of the handle support structure 140. For example, the second set 190 of support portion 184 may comprise a fifth support portion 192 (e.g., fifth support portion 164), a sixth support portion 194 (e.g., sixth support portion 166), a seventh support portion 196 (e.g., seventh support portion 168), and an eighth support portion 198 (e.g., eighth support portion 170).

The exercise training device 100 comprises one or more handle portions, such as a handle portion 200 and a second handle portion 202. In an example, the handle portion 200 can be attached to one of the sled portion 102, the second sled portion 104, or the support structure 132. For example, the handle portion 200 can be removably attached to the handle support structure 140, which may be attached to the sled portion 102, the second sled portion 104, and/or the support structure 132. The handle portion 200 is configured to allow a user to grip the exercise training device 100 and move the exercise training device along the surface.

The handle portion 200 extends between a first end 204 and a second end 206. In an example, the first end 204 can engage one of the support portions 144. In the example of FIG. 1, the first end 204 of the handle portion 200 engages the third support portion 154, though the handle portion 200 can engage any of the support portions 144. By "engaging" the support portions 144, it will be appreciated that, in an example, the first end 204 of the handle portion 200 can be received within the openings (e.g., the first opening 160, the second opening 164, etc.) that are defined by the support portions. The first end of the handle portion 200 can be retained with respect to the support portions 144, such as with a mechanical fastener (e.g., clamping device, screw, bolt, etc.). In a first position (e.g., as illustrated), the mechanical fastener can contact the handle portion 200 and the support portions 144 to limit the handle portion 200 from being removed from the opening defined by the support portion 144. In a second position, the mechanical fastener can be removed, thus allowing for insertion and/or removal of the handle portion 200 from the support portions 144.

In an example, the second end 206 of the handle portion 200 is configured to be gripped by a user. The second end 206 comprises a grip 208 (e.g., handle, lever, etc.) that can be gripped by a user, a cylindrical structure 210, and a support bar 212. In this way, the handle portion 200 is configured to allow the user to grip the exercise training device 100 and move the exercise training device 100 along the surface. In an example, the grip 208 is attached to the support bar 212 of the handle portion 200 by the cylindrical structure 210. In an example, the grip 208 is disposed within a circumference of the cylindrical structure 210.

In an example, the second handle portion 202 can be attached to one of the sled portion 102, the second sled portion 104, or the support structure 132. For example, the second handle portion 202 can be removably attached to the handle support structure 140, which may be attached to the sled portion 102, the second sled portion 104, and/or the support structure 132. The second handle portion 202 is configured to allow a user to grip the exercise training device 100 and move the exercise training device along the surface.

The second handle portion 202 extends between a first end 214 and a second end 216. In an example, the first end 214 can engage one of the support portions 144. In the example of FIG. 1, the first end 214 of the second handle portion 202 engages the seventh support portion 168, though the handle portion 200 can engage any of the support portions 144. By "engaging" the support portions 144, it will be appreciated that, in an example, the first end 214 of the second handle portion 202 can be received within the openings (e.g., the fifth opening 174, the sixth opening 178, etc.) that are defined by the support portions. The first end 214 of the second handle portion 202 can be retained with respect to the support portions 144, such as with a mechanical fastener (e.g., clamping device, screw, bolt, etc.). In a first position (e.g., as illustrated), the mechanical fastener can contact the second handle portion 202 and the support portions 144 to limit the second handle portion 202 from being removed from the opening defined by the support portion 144. In a second position, the mechanical fastener can be removed, thus allowing for insertion and/or removal of the second handle portion 202 from the support portions 144.

In an example, the second end 216 of the second handle portion 202 is configured to be gripped by a user. The second end 216 comprises a grip 218 (e.g., handle, lever, etc.) that can be gripped by a user. In this way, the second handle portion 202 is configured to allow the user to grip the exercise training device 100 and move the exercise training device 100 along the surface.

In this way, the user can grip the handle portion 200 with one hand, and the second handle portion 202 with a second hand. For example, the user can grip the handle portion 200 with his/her left hand, and can grip the second handle portion 202 with his/her right hand. The user can therefore apply a force to the handle portion 200 and the second handle portion 202, with the force causing the exercise training device 100 to move with respect to the surface.

The user can select and adjust a separating distance between the handle portion 200 and the second handle portion 202. For example, the user can insert the handle portion 200 and the second handle portion 202 in the outermost support portions (e.g., the fourth support portion 156 and the eighth support portion 170), such that a maximum distance between the handle portion 200 and the second handle portion 202 is achieved. This position can, for example, train a first set of the user's muscles when he/she is pushing the exercise training device 100. In a second example, the user can insert the handle portion 200 and the second handle portion 202 in the innermost support portions (e.g., the first support portion 150 and the fifth support portion 164), such that a minimum distance between the handle portion 200 and the second handle portion 202 is achieved. This position can, for example, train a second set of the user's muscles when he/she is pushing the exercise training device 100.

In addition, the handle portion 200 and/or the second handle portion 202 can be angled (e.g., due to the angles (e.g., 148, 162) defined by the support portions 144), thus allowing for the user to grip the handle portion 200 and/or the second handle portion 202 with a more natural hand, arm, shoulder, etc. position. For example, the handle portion 200 and/or the second handle portion 202 can be angled relative to the sled portions 102, 104 such that the handle portion 200 and/or the second handle portion 202 are at other than a 90 degree angle relative to the first plane. Such an angled, non-90 degree orientation provides the benefit to the athlete that the athlete's hands, arms, shoulders, etc. may more closely mimic the athlete's (e.g., intended) hand, arm, shoulder, etc. position(s) during athletic competition (e.g., football). In addition, in an example, specific muscles of the athlete may be trained (e.g., as desired to establish muscle memory, teach proper technique, etc.) due to the non-90 degree orientation.

Referring now to FIG. 3, a side view of the exercise training device 100 along lines 3-3 of FIG. 1 is illustrated. In an example, the exercise training device 100 can rest upon a surface 300, such as the ground, a playing surface (e.g., a turf field, a grass field, etc.), etc. In an example, the sled portions (e.g., the sled portion 102, the second sled portion 104, etc.) can extend along a first plane 302 that is substantially parallel to the surface 300 upon which exercise training device 100 is supported. The support structure 132, which is illustrated with phantom lines in FIG. 3 due to the support structure 132 being obscured from view by the sled portion 102, can extend along a second plane 304. In an example, the second plane 304 may be substantially parallel to the first plane 302 and to the surface 300. In this way, the exercise training device 100 can move along the surface 300, with the first plane 302 and the second plane 304 maintained substantially parallel to the surface 300 during movement. As such, the support structure 132 can support the exercise weights 136 with limited likelihood of the exercise weights 136 falling off of the support structure 132.

Figure 4:
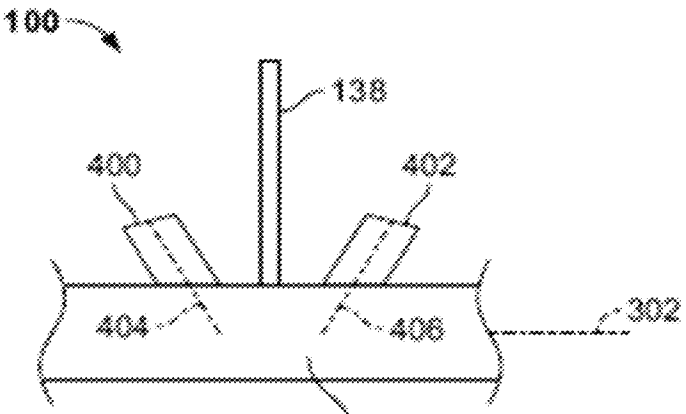
FIG. 4 is an illustration of a side of an example training device.
Figure 5:
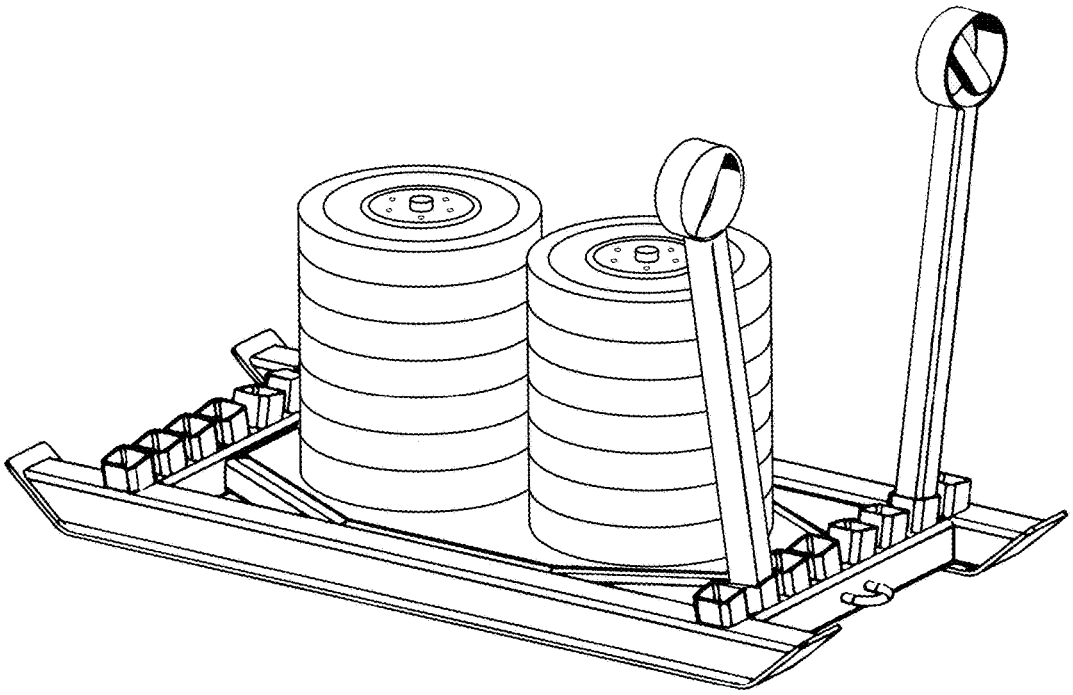
FIG. 5 is an illustration of an example training device.
Figure 6:
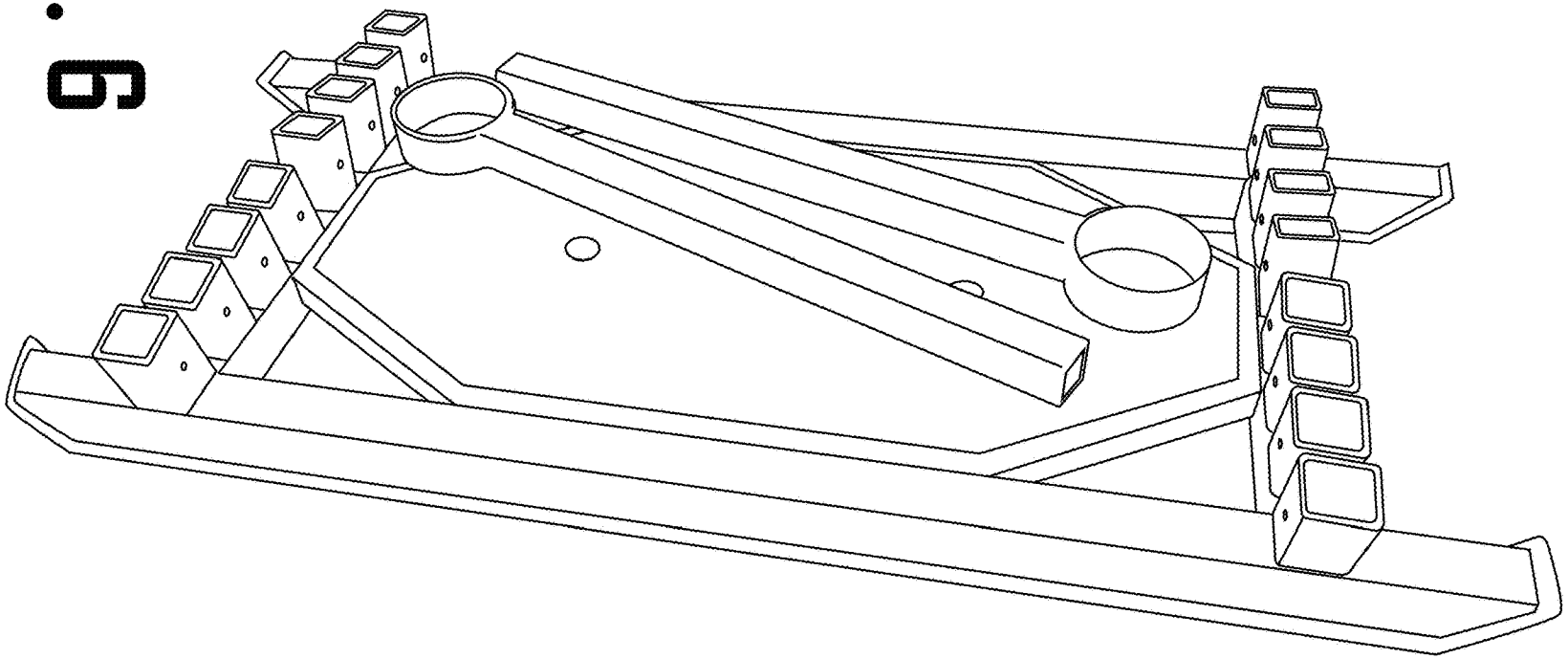
FIG. 6 is an illustration of an example training device.
Figure 7:
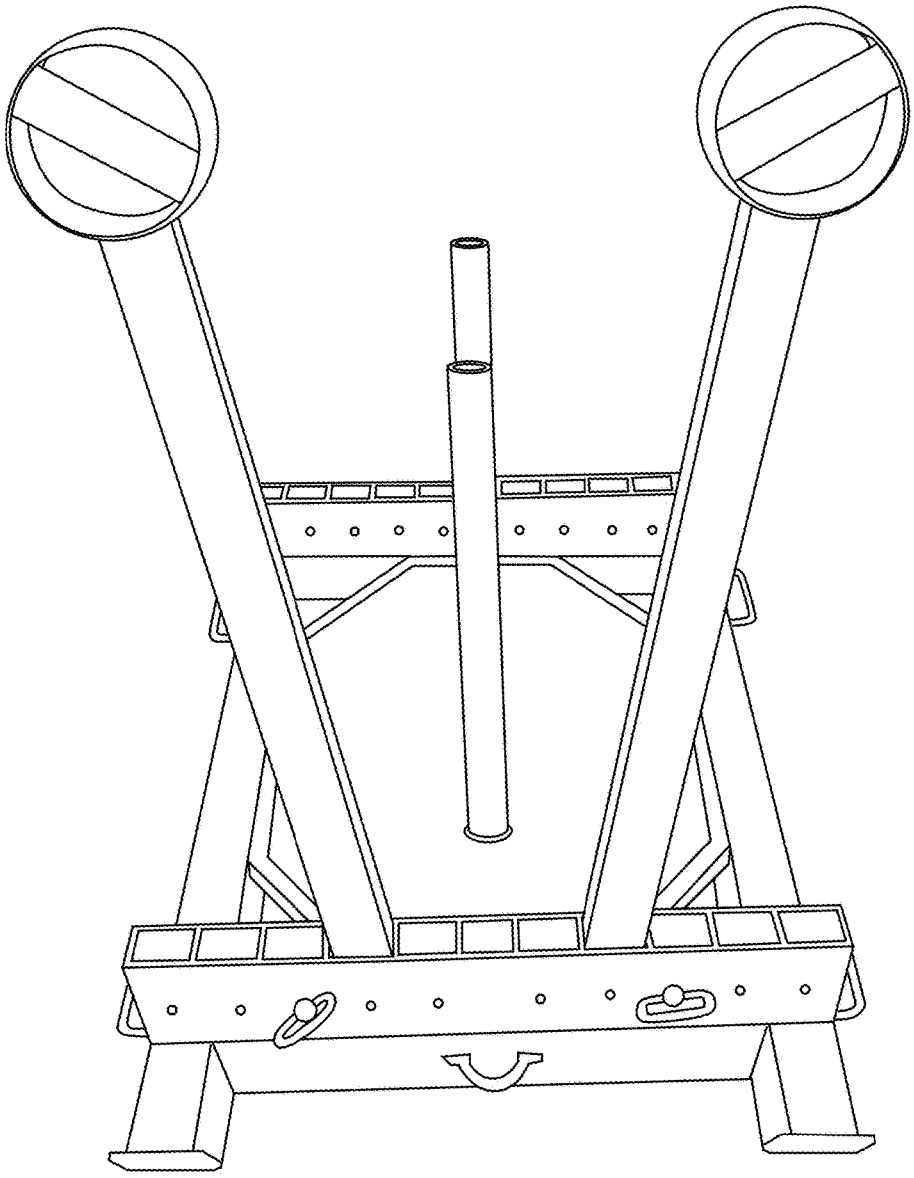
FIG. 7 is an illustration of an example training device.
Figure 8:
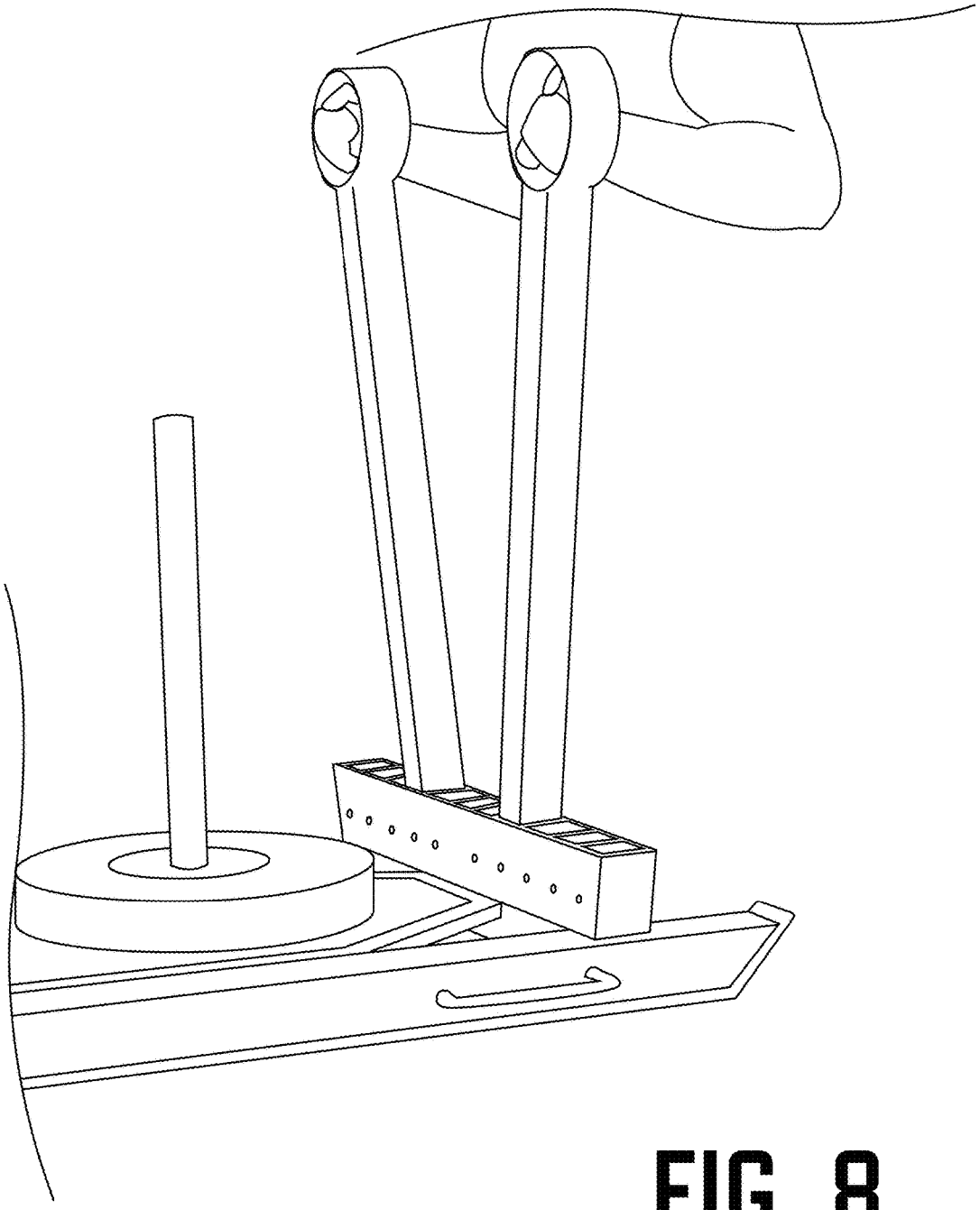
FIG. 8 is an illustration of an example training device.
Figure 9:
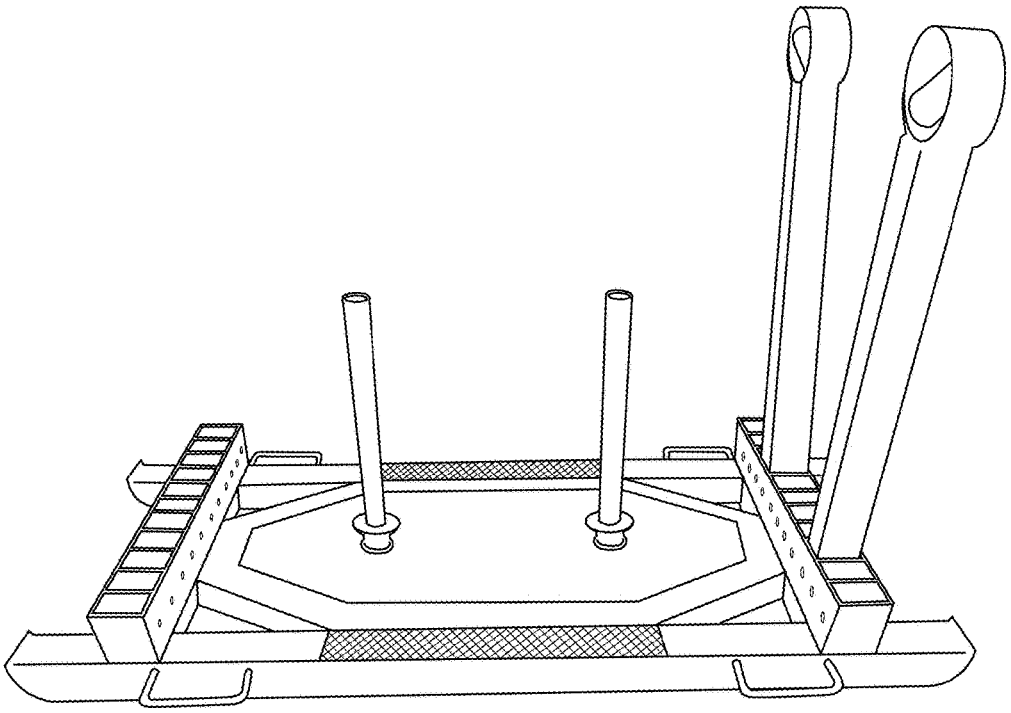
FIG. 9 is an illustration of an example training device.
Figure 10:
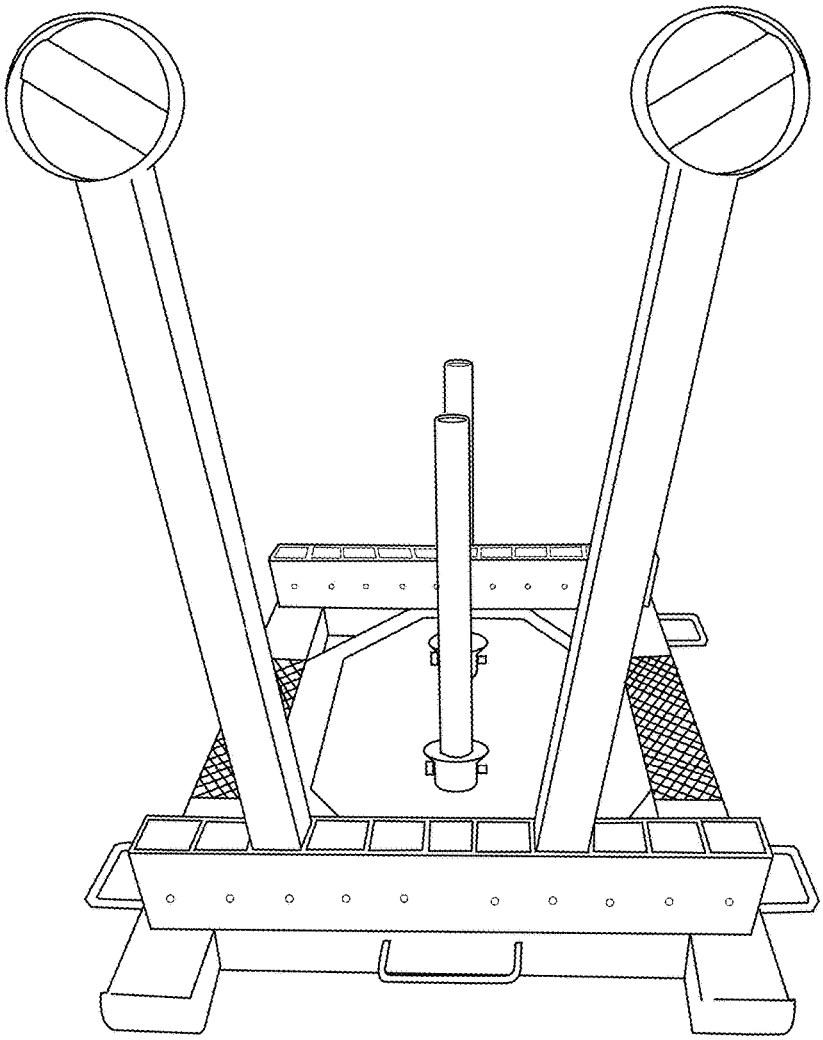
FIG. 10 is an illustration of an example training device.
Figure 11:
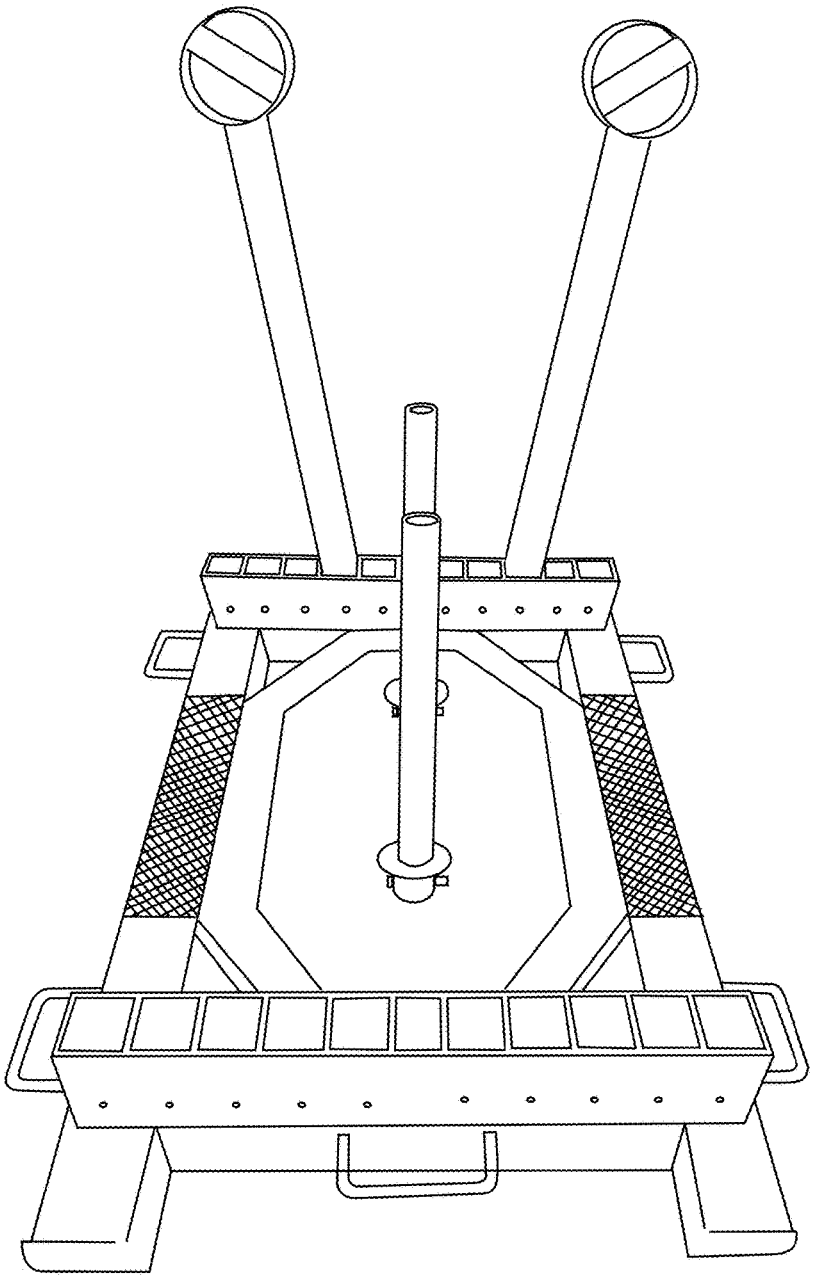
FIG. 11 is an illustration of an example training device.
Figure 12:
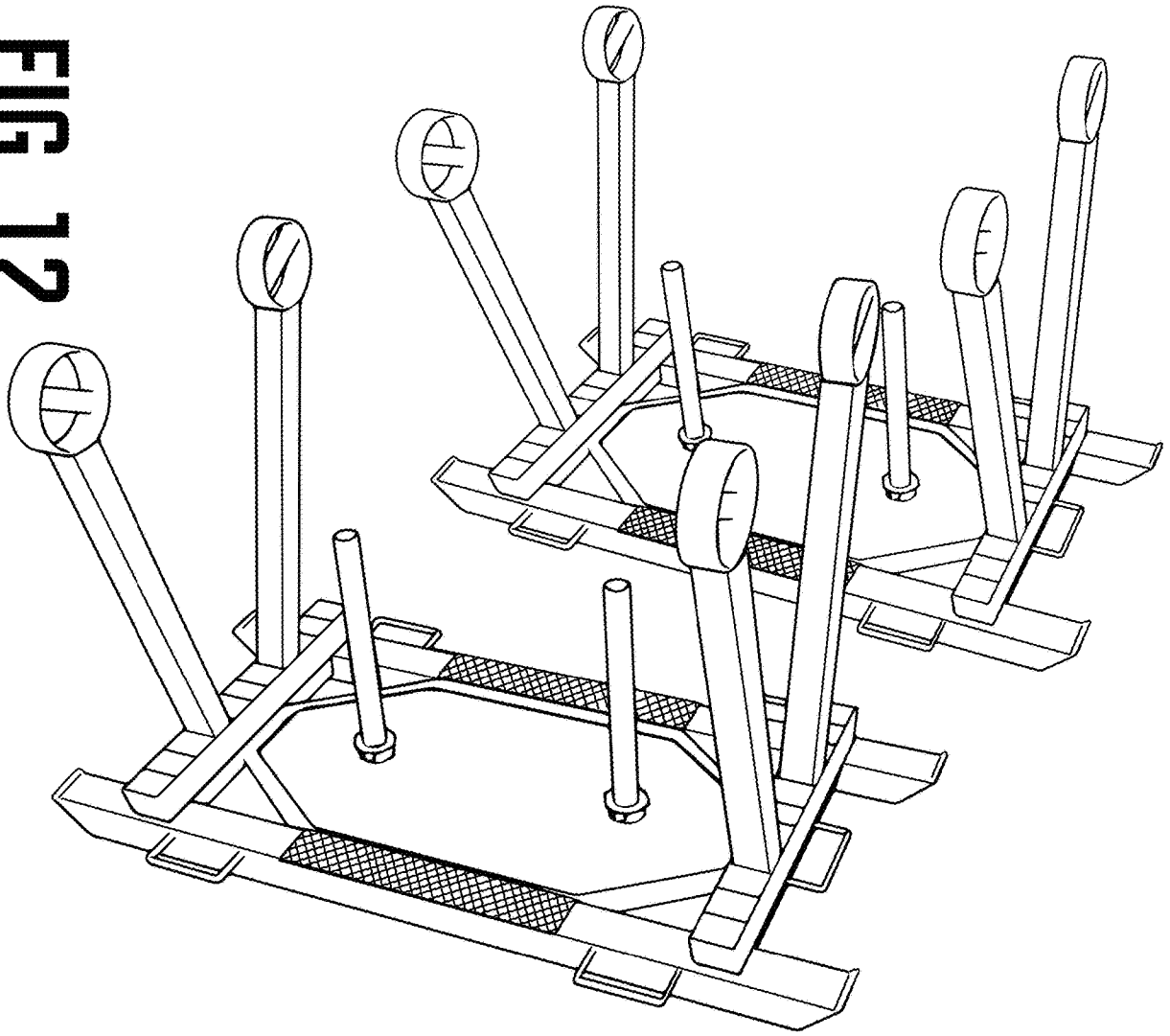
FIG. 12 is an illustration of an example training device.
Figure 13:
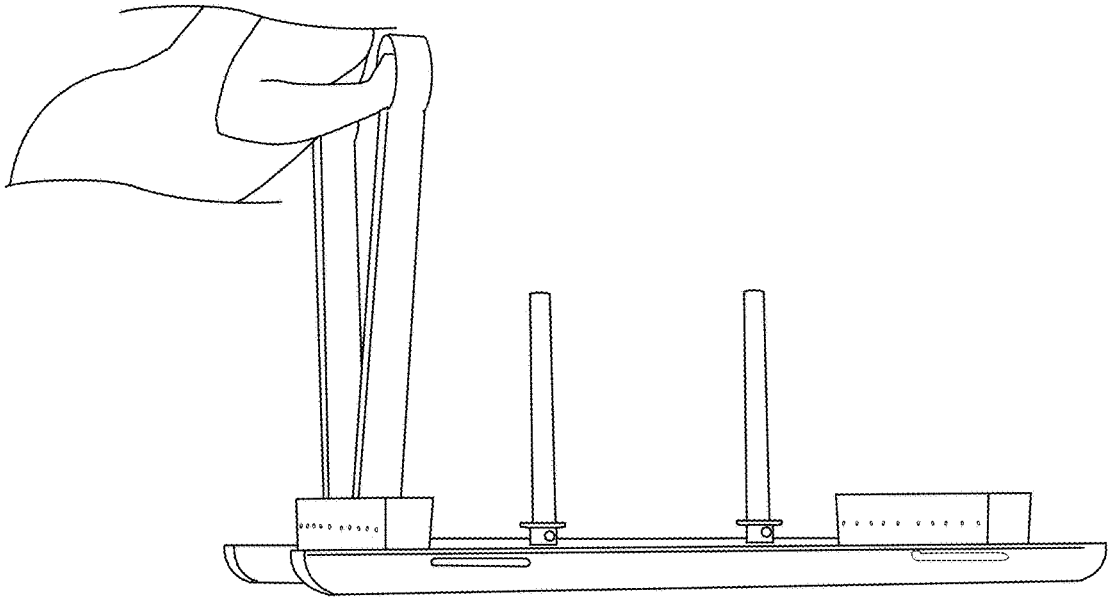
FIG. 13 is an illustration of an example training device.
Figure 14:
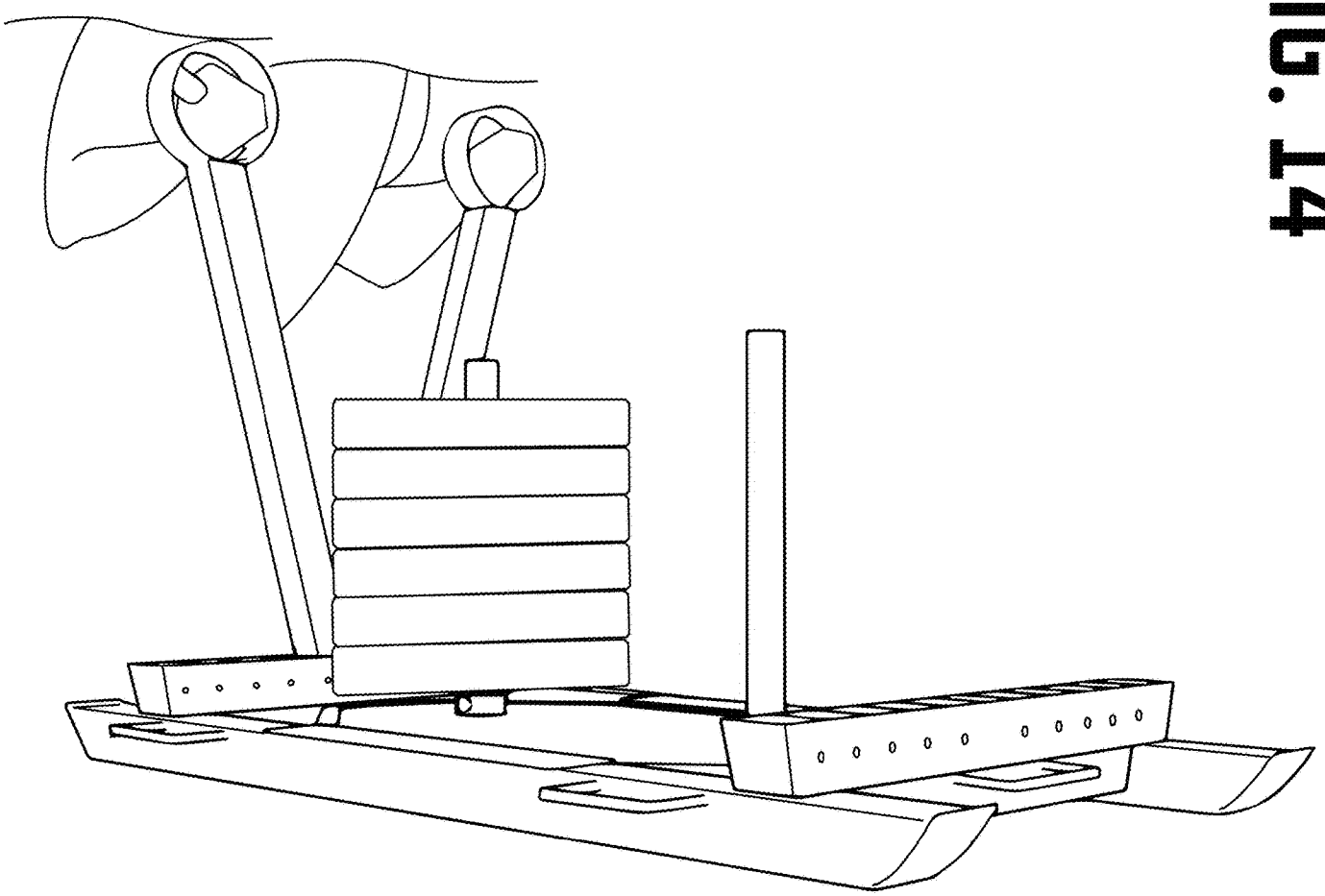
FIG. 14 is an illustration of an example training device.
Figure 15:
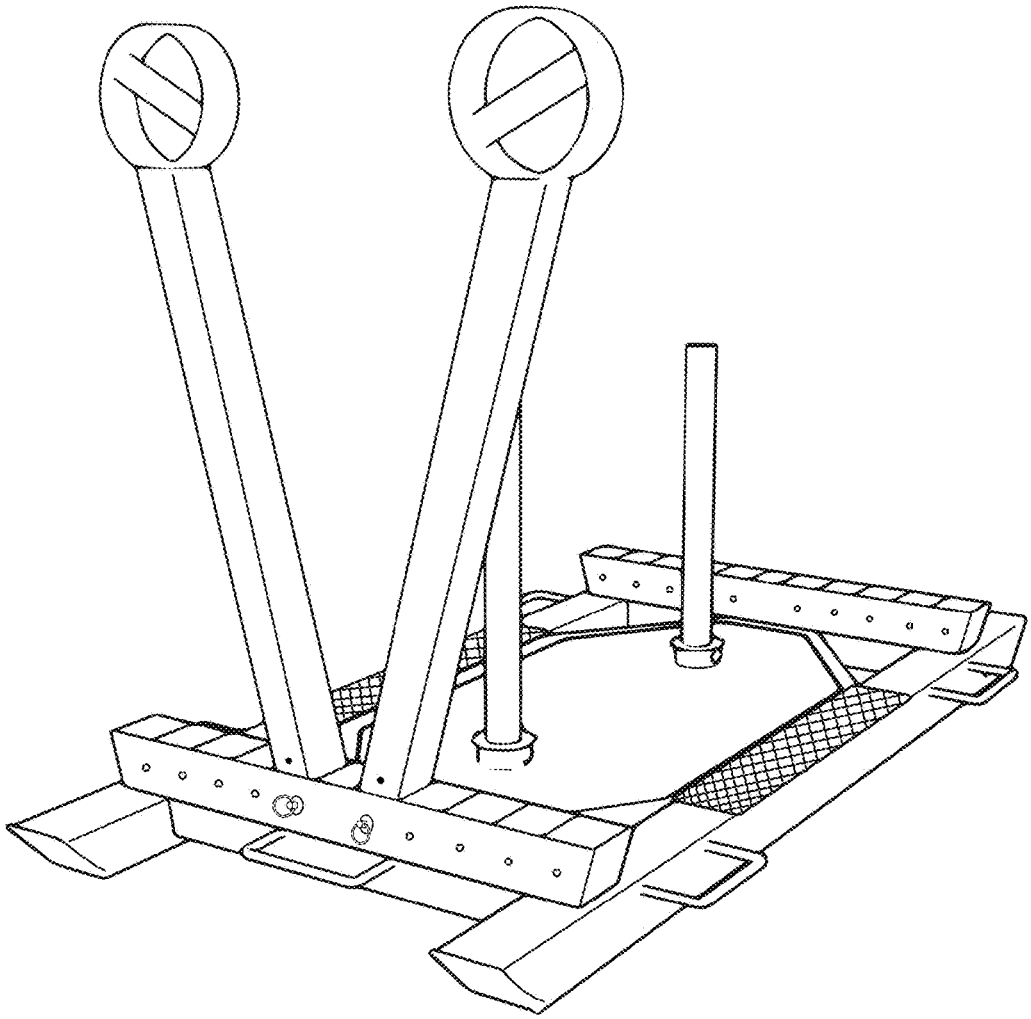
FIG. 15 is an illustration of an example training device.
Figure 16:
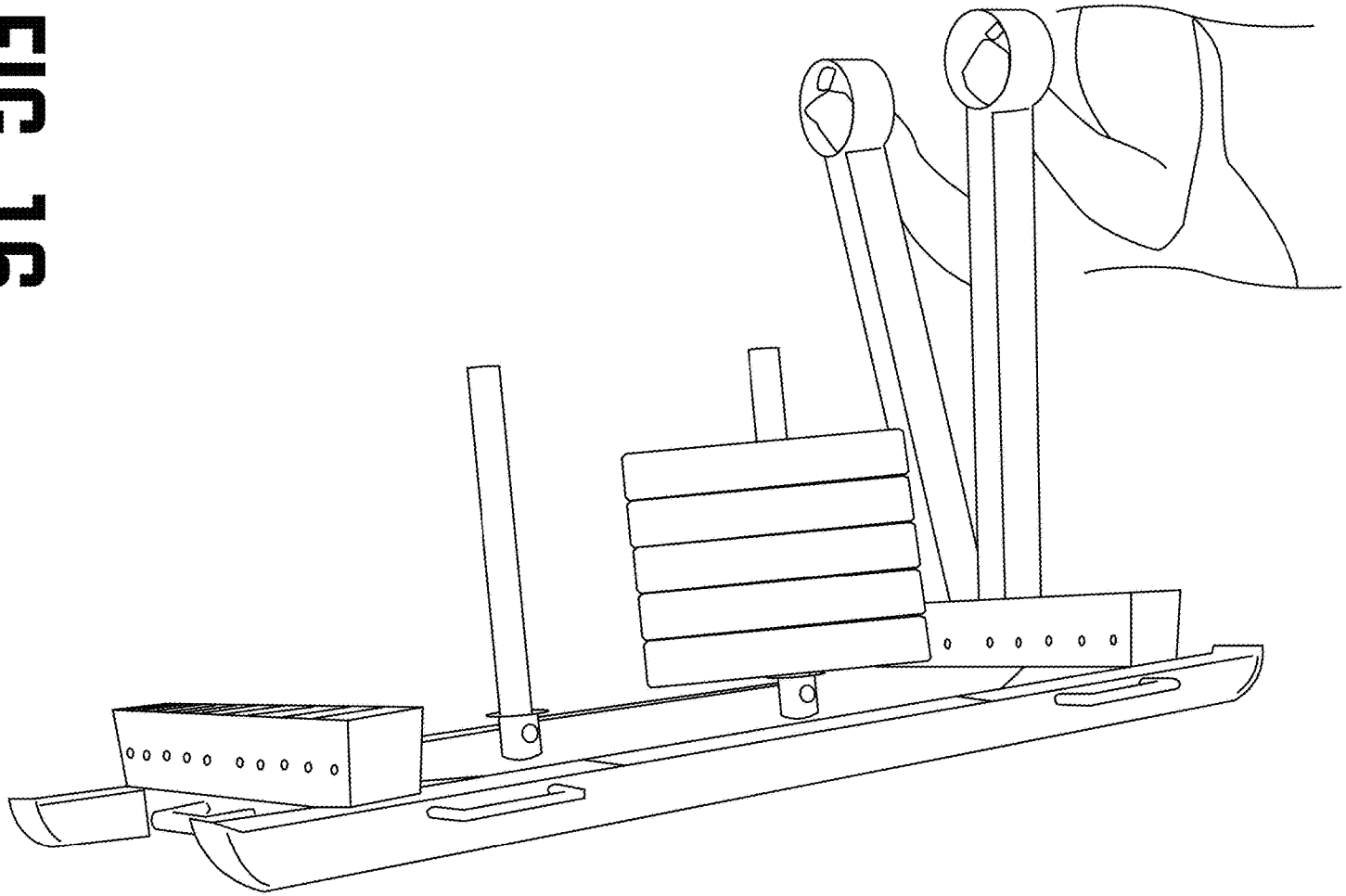
FIG. 16 is an illustration of an example training device.
Figure 17:
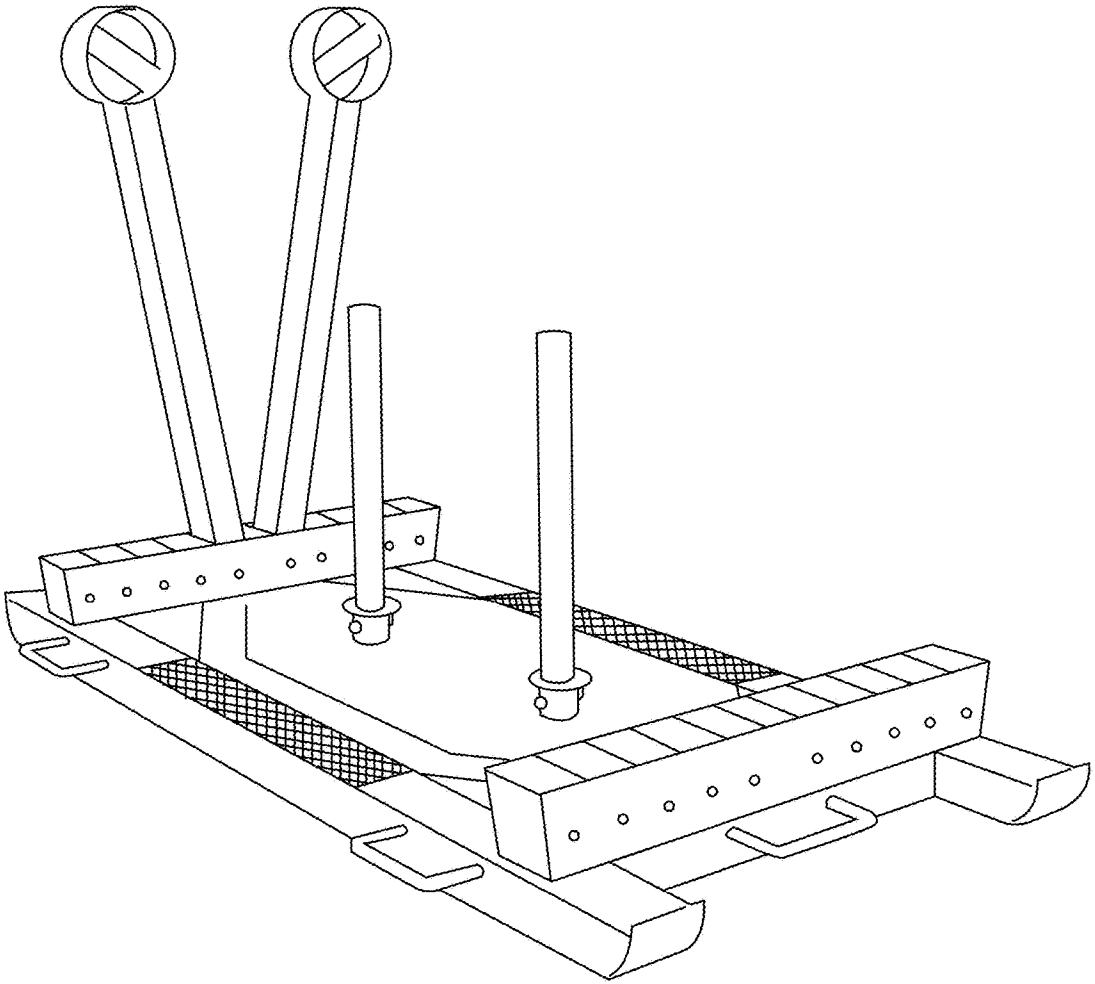
FIG. 17 is an illustration of an example training device.

Referring to FIG. 4, a front view of the exercise training device 100 along lines 4-4 of FIG. 1 is illustrated. In an example, the exercise training device 100 comprises a first support portion 400 and a second support portion 402. The first support portion 400 can extend along a first axis 404 that is non-perpendicular with respect to the first plane 302 and the second plane 304. In an example, the first axis 404 can define the first angle 148 (e.g., illustrated in FIG. 1) with respect to the first plane 302. The first angle 148 may be between about 10 degrees to about 80 degrees, or between about 30 degrees to about 60 degrees.

In an example, the second support portion 402 can extend along a second axis 406 that is non-perpendicular with respect to the first plane 302 and the second plane 304. In an example, the second axis 406 can define the second angle 162 (e.g., illustrated in FIG. 1) with respect to the first plane 302. The second angle 162 may be between about 10 degrees to about 80 degrees, or between about 30 degrees to about 60 degrees. In an example, the first axis 404 may be non-parallel with respect to the second axis 406.

FIGS. 5 to 17 illustrate various examples of the exercise training device 100.

The foregoing outlines features of several embodiments so that those of ordinary skill in the art may better understand various aspects of the present disclosure. Those of ordinary skill in the art should appreciate that they may readily use the present disclosure as a basis for designing or modifying other processes and structures for carrying out the same purposes and/or achieving the same advantages of various embodiments introduced herein. Those of ordinary skill in the art should also realize that such equivalent constructions do not depart from the spirit and scope of the present disclosure, and that they may make various changes, substitutions, and alterations herein without departing from the spirit and scope of the present disclosure.

Although the subject matter has been described in language specific to structural features or methodological acts, it is to be understood that the subject matter of the appended claims is not necessarily limited to the specific features or acts described above. Rather, the specific features and acts described above are disclosed as example forms of implementing at least some of the claims.

Various operations of embodiments are provided herein. The order in which some or all of the operations are described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

It will be appreciated that layers, features, elements, etc. depicted herein are illustrated with particular dimensions relative to one another, such as structural dimensions or orientations, for example, for purposes of simplicity and ease of understanding and that actual dimensions of the same differ substantially from that illustrated herein, in some embodiments.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application and the appended claims are generally be construed to mean "one or more" unless specified otherwise or clear from context to be directed to a singular form. Also, at least one of A and B and/or the like generally means A or B or both A and B. Furthermore, to the extent that "includes", "having", "has", "with", or variants thereof are used, such terms are intended to be inclusive in a manner similar to the term "comprising".

Also, unless specified otherwise, "first," "second," or the like are not intended to imply a temporal aspect, a spatial aspect, an ordering, etc. Rather, such terms are merely used as identifiers, names, etc. for features, elements, items, etc. For example, a first element and a second element generally correspond to element A and element B or two different or two identical elements or the same element.

Also, although the disclosure has been shown and described with respect to one or more implementations, equivalent alterations and modifications will occur to others of ordinary skill in the art based upon a reading and understanding of this specification and the annexed drawings. The disclosure comprises all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. An exercise training device comprising:

a sled portion extending along a first plane that is substantially parallel to a surface upon which the exercise training device is supported, wherein the sled portion comprises a first side that is in contact with the surface;

a support structure, attached to the sled portion, comprising a support surface that extends along a second plane that is substantially parallel to the first plane, wherein the support surface is configured to support an exercise weight;

a handle support structure attached to at least one of the sled portion or the support structure, wherein the handle support structure comprises:

a first support portion that extends along a first axis that is non-perpendicular with respect to the first plane and the second plane; and a second support portion that extends along a second axis that is non-perpendicular with respect to the first plane and the second plane, the first axis is non-parallel with respect to the second axis; and a first handle portion configured to be selectively attached to the first support portion and selectively attached to the second support portion, wherein:

a position of the first handle portion relative to the sled portion and the support structure when the first handle portion is selectively attached to the first support portion is different than a position of the first handle portion relative to the sled portion and the support structure when the first handle portion is selectively attached to second support portion, and the first handle portion is configured to allow a user to grip the exercise training device and move the exercise training device along the surface.

2. The exercise training device of claim 1, wherein the support structure comprises an engagement member attached to the support surface, the engagement member extending linearly opposite the surface.

3. The exercise training device of claim 2, wherein the engagement member is configured to receive the exercise weight and maintain the exercise weight with respect to the support surface.

4. The exercise training device of claim 1, wherein:

the handle support structure comprises a third support portion, the exercise training device comprises a second handle portion configured to be selectively attached to the third support portion, the first handle portion is spaced a first distance away from the second handle portion when the first handle portion is selectively attached to the first support portion and the second handle portion is selectively attached to the third support portion, the first handle portion is spaced a second distance away from the second handle portion when the first handle portion is selectively attached to the second support portion and the second handle portion is selectively attached to the third support portion, and the first distance is different than the second distance.

5. The exercise training device of claim 1, wherein:

the first support portion comprises a first wall that defines a first opening within which the first handle portion is removably received when the first handle portion is selectively attached to the first support portion, and the second support portion comprises a second wall that defines a second opening within which the second handle portion is removably received when the first handle portion is selectively attached to the second support portion.

6. The exercise training device of claim 1, comprising:

a second sled portion, wherein:

the handle support structure comprises a support bar extending between the sled portion and the second sled portion, the support bar comprises a first side facing the surface and a second side diametrically opposite the first side, and the first support portion and the second support portion are disposed above the second side of the support bar.

7. The exercise training device of claim 1, wherein:

the sled portion comprises a second side diametrically opposite the first side, the first support portion and the second support portion are disposed above the second side of the sled portion, the exercise training device comprises a second handle support structure comprising a third support portion, the first handle portion is configured to be selectively attached to the third support portion, the handle support structure is disposed adjacent a first end of the sled portion, and the second handle support structure is disposed adjacent a second end of the sled portion diametrically opposite the first end of the sled portion.

8. An exercise training device comprising:

a sled portion extending along a first plane that is substantially parallel to a surface upon which the exercise training device is supported, wherein the sled portion comprises a first side that is in contact with the surface;

a support structure, attached to the sled portion, comprising a support surface that extends along a second plane that is substantially parallel to the first plane, wherein the support surface is configured to support an exercise weight;

a handle support structure attached to at least one of the sled portion or the support structure, wherein the handle support structure comprises a first support portion and a second support portion;

a first handle portion configured to be removably attached to the first support portion, wherein:

the first support portion comprises a first wall that defines a first opening within which the first handle portion is removably received, and the first support portion extends along a first axis that is non-perpendicular with respect to the first plane and the second plane; and a second handle portion configured to be removably attached to the second support portion, wherein:

the second support portion comprises a second wall that defines a second opening within which the second handle portion is removably received, the second support portion extends along a second axis that is non-perpendicular with respect to the first plane and the second plane, the first axis is non-parallel with respect to the second axis, and the first handle portion and the second handle portion are configured to allow a user to grip the exercise training device and move the exercise training device along the surface.

9. The exercise training device of claim 8, wherein the support structure comprises an engagement member attached to the support surface, the engagement member extending linearly opposite the surface.

10. The exercise training device of claim 9, wherein the engagement member is configured to receive the exercise weight and maintain the exercise weight with respect to the support surface.

11. An exercise training device comprising:

a sled portion extending along a first plane that is substantially parallel to a surface upon which the exercise training device is supported, wherein the sled portion comprises a first side that is in contact with the surface;

a support structure, attached to the sled portion, comprising a support surface that extends along a second plane that is substantially parallel to the first plane, wherein the support surface is configured to support an exercise weight;

a handle support structure attached to at least one of the sled portion or the support structure, wherein the handle support structure comprises:

a first support portion that extends along a first axis that is non-perpendicular with respect to the first plane and the second plane;

a second support portion that extends along a second axis that is non-perpendicular with respect to the first plane and the second plane; and a third support portion that extends along a third axis that is non-perpendicular with respect to the first plane and the second plane;

a first handle portion configured to be selectively attached to the first support portion and selectively attached to the second support portion; and a second handle portion configured to be selectively attached to the third support portion, wherein:

a position of the first handle portion relative to the sled portion and the support structure when the first handle portion is selectively attached to the first support portion is different than a position of the first handle portion relative to the sled portion and the support structure when the first handle portion is selectively attached to second support portion, the first handle portion is configured to allow a user to grip the exercise training device and move the exercise training device along the surface, the third axis is non-parallel with respect to the first axis and the second axis, and the first axis is non-parallel with respect to the second axis.

12. The exercise training device of claim 11, wherein the first handle portion comprises a support bar and a grip attached to the support bar.

13. The exercise training device of claim 12, comprising a cylindrical structure, wherein the grip is attached to the support bar by the cylindrical structure.

14. The exercise training device of claim 13, wherein the grip is disposed within a circumference of the cylindrical structure.

* * * * *